United States Patent [19]

Benuzzi

[11] 4,206,670

[45] Jun. 10, 1980

[54] DEVICE FOR THE LONGITUDINAL SHORTENING OF PANELS IN PANEL CUTTING MACHINES

[75] Inventor: Gino Benuzzi, Bologna, Italy

[73] Assignee: Giben Impianti S.p.A., Bologna, Italy

[21] Appl. No.: 834,354

[22] Filed: Sep. 19, 1977

[30] Foreign Application Priority Data

Sep. 20, 1976 [IT] Italy ..... 12798 A/76

[51] Int. Cl.[2] ..... B27B 5/18; B27B 9/04

[52] U.S. Cl. ..... 83/404.2; 83/417; 83/268; 83/391; 83/467 R

[58] Field of Search ..... 83/417, 418, 391, 467 R, 83/468, 268, 71, 234, 262, 374, 404.2, 471.2

[56] References Cited

U.S. PATENT DOCUMENTS

| | | | |
|---|---|---|---|
| 3,141,367 | 7/1964 | Keener et al. | 83/268 |
| 3,813,980 | 6/1974 | Rand et al. | 83/467 |
| 3,910,142 | 10/1975 | Jureit et al. | 83/485 |

FOREIGN PATENT DOCUMENTS

| | | | |
|---|---|---|---|
| 1426623 | 3/1976 | United Kingdom | 83/404.2 |

*Primary Examiner*—Donald R. Schran

*Attorney, Agent, or Firm*—Pollock, Vande Sande & Priddy

[57] ABSTRACT

The device for the longitudinal trimming of a panel or stack of panels to be fed to a panel cutting machine comprises an elevating table onto which there is loaded a pile of panels. The elevating table is raised a predetermined distance so as to bring to the level of the panel support table of the cutting machine a stack of a predetermined number of panels. The stack of panels is transversely and longitudinally aligned, by means of transversal and lateral abutment or reference members, is then pushed a predetermined distance in the transverse direction and is then subjected to the action of a longitudinal trimming saw which cuts one or more strips from the side of the stack of panels. The thus reduced stack of panels is then fed to a crosscut saw on the panel support table to be subjected to transverse cutting and other panel sizing operations.

2 Claims, 9 Drawing Figures

DEVICE FOR THE LONGITUDINAL SHORTENING OF PANELS IN PANEL CUTTING MACHINES

SUMMARY OF THE INVENTION

The present invention relates to panel cutting machines of the type in which panels or stacks of panels are longitudinally fed on a panel support table, and are subjected to transverse cutting effected by a crosscut saw in correspondence of a transverse cutting line. More particularly, the invention relates to a device for the longitudinal trimming of the panel or stack of panels, prior to their transverse cutting, by cutting at least one strip from a longitudinal side of the said panel or stack of panels.

The device according to the invention comprises an elevating table onto which there is loaded a pile of panels. The elevating table is lifted by a predetermined amount, so as to bring to the level of the panel support table a single panel or a stack of a predetermined number of panels. The said panel (or stack of panels) is transversely and longitudinally aligned, by means of suitable transverse and lateral abutment members, is then pushed in a transverse direction by a predetermined amount, and is then subjected to the action of a longitudinal trimming saw which cuts one or more strips from the longitudinal side of the panel (or stack of panels).

The thus reduced panel (or stack of panels) is then fed to the crosscut saw to be subjected to transverse cutting and other subsequent panel sizing operations.

The above and other features of the invention, and the advantages deriving therefrom, will appear evident from the following description of a preferred embodiment, made with reference to the attached sheets of drawings.

DESCRIPTION OF THE PREFERRED EMBODIMENT

Figure 1:
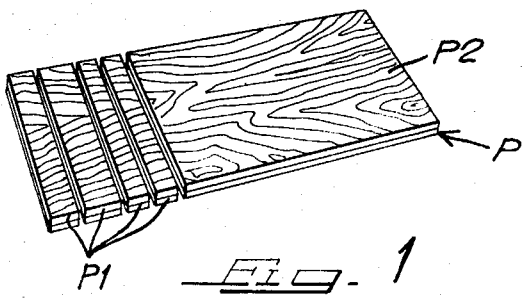
FIG. 1 is a perspective view showing a stack of two superposed panels, from which there have been cut, by longitudinal cutting, a plurality of strips, so as to obtain the longitudinal trimming of the stack.

Referring to FIG. 1, from a panel or stack of superposed panels P there are cut, by means of one or more longitudinal cuts, one or more strips P1 having equal or different widths, which strips P1 are then removed from the residual stack of panels P2 and conveyed to subsequent processing stations, while the residual stack P2 is inserted in the normal cycle of a panel cutting machine.

Figure 6:
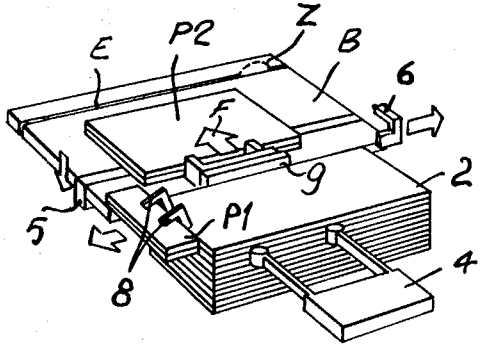

It is preliminarily to be noted that the terms "longitudinal" and "transverse" used throughout the description and claims refer to the direction of movement of the panels P along the panel cutting machine. Thus, for example, referring to FIG. 6, the panels P2 are fed in the longitudinal direction F of the machine, and are subjected to the transverse cut of a crosscut or transverse saw Z moving along a transverse cutting line E, and therefore, referring back to FIG. 1, the panel strips P1 are cut from the panels P by means of longitudinal cuts.

Figure 2:
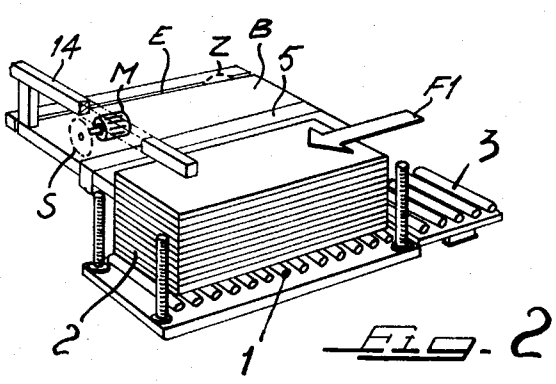
FIG. 2 is a perspective view showing diagrammatically the elevating table for the feeding to a panel cutting machine which employs the trimming device according to the invention.
Figure 3:
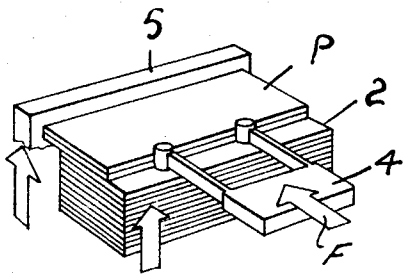
FIGS. 3, 4, 5 and 6 are perspective views showing diagrammatically as many corresponding operating steps of the trimming device according to the invention.

Referring now to FIG. 2, reference numeral 1 indicates the elevating table of a panel cutting machine, onto which there is loaded a stack 2 of panels, coming from a suitable feeding line 3. The stack 2 of panels is lifted by a predetermined amount, and then a longitudinal pusher 4 (see FIG. 3) acting in the longitudinal direction F, pushes a predetermined number of superposed panels P (or even a single panel) against a transverse abutment 5 which has been lifted with respect to the horizontal surface of the supporting table B of the cutting machine. In this manner, the panel or stack of panels P come to be transversely aligned.

Figure 4:
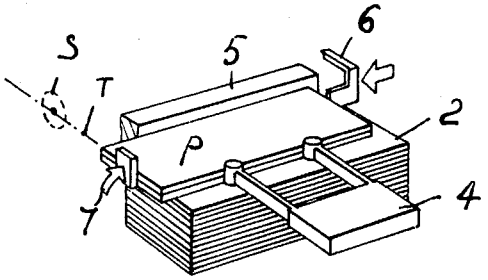

Subsequently, as shown in FIG. 4, one side of the panel stack P is acted upon by a side pusher 6 which pushes the opposed side against a previously lifted vertical side abutment 7. In this manner the panel stack P comes to be longitudinally aligned. The line of longitudinal alignment, determined by abutment 7, coincides with the longitudinal cutting line T of a longitudinal or trimming saw S, which is movable above the stack of panels itself, as will be explained hereinafter.

Figure 5:
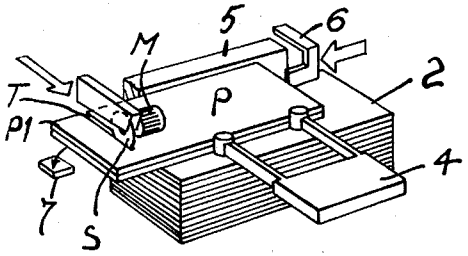

At this stage, the side abutment member 7 is lowered below the stack P of panels, and the side pusher 6 pushes the stack P beyond the cutting line T by a predetermined amount. After this further displacement of the stack P, the longitudinal trimming saw S enters into action (FIG. 5) and cuts the desired strip P1 from the stack P. If more than one strip P1 is to be cut, the side pusher 6 again is activated, and subsequently the trimming saw S.

Once the trimming operation is terminated, the strips P1 are removed by a remover element 8, while the residual stack P2 is pushed by the longitudinal pusher 9 into the working cycle, to be subjected to the action of the crosscut saw Z along the transverse cutting line E. The trimming cycle can then be repeated.

Figure 8:
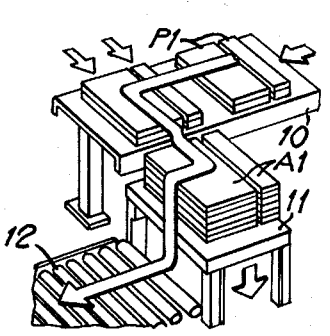
FIGS. 7 and 8 show diagrammatically in perspective view two different modes of removing the longitudinal strips cut from the panel or stack of panels.
Figure 7:
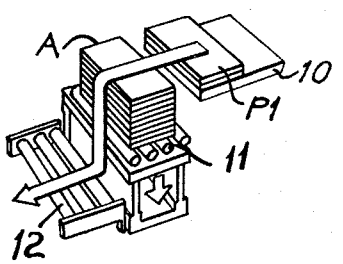

The stacks of strips P1 can be collected in a single stack or pile A, as shown in FIG. 7, from which it can be appreciated that the single stacks P1 of panel strips are discharged from table 10 onto a vertically movable supporting table 11, which is progressively lowered until it reaches the level of a discharge conveyor 12. In FIG. 8 there is shown a different arrangement of the discharge of stacks P1 of panel strips having different widths, which stacks are collected in a pile A1 substantially composed of two adjacent piles of strips of different widths.

Figure 9:
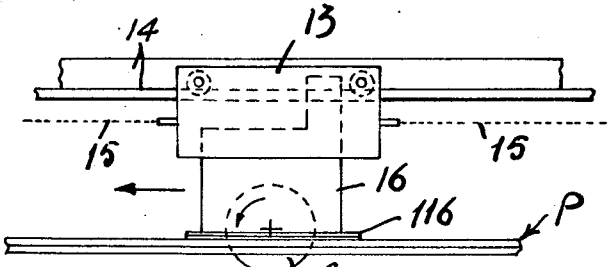
FIG. 9 is a side elevation view showing diagrammatically a detail of the unit of the trimming saw of the device according to the invention.

Referring to FIG. 9, there is shown in detail the unit of the trimming saw S. The saw S is supported inside a casing 16 which is provided at its lower end with a pad 116 lined with felt or similar low friction material for sliding onto the upper surface of the panels P. The saw S and casing 16 are mounted on a carriage 13 which runs on a rail 14 under the action of a chain 15 suitably driven by means not shown.

I claim:

1. In a panel cutting machine, of the type in which panels are longitudinally fed on a panel support table, to be subjected to transverse cutting by a crosscut saw along a transverse cutting line, a device for the longitudinal trimming of the panels by cutting at least one strip from a longitudinal side thereof prior to transverse cutting thereof, said trimming device comprising:

(a) a side reference member for providing an abutment for the longitudinal side of a panel to be trimmed, said side reference member being movable toward and away from said panel;

(b) a circular saw movable along a longitudinal cutting line located along the side of said panel to be trimmed and having its axis of rotation above said panel to be trimmed, said side reference member being arranged for movement toward and away from the longitudinal cutting line of said circular saw;

(c) a side pusher, arranged at the side of said panel opposite to the side to be trimmed, said side pusher being movable transversely to the longitudinal direction of feeding of said panel;

(d) an elevating table for intermittently elevating a pile of panels loaded thereon in predetermined amounts so as to bring to the same level of the panel support table a predetermined number of panels;

(e) a longitudinal pusher for pushing said predetermined number of panels from said pile onto said panel support table;

(f) a transverse abutment for the transverse alignment of said predetermined number of panels engaged by said longitudinal pusher, arranged between said elevating table and said panel support table, and being movable in and out of the way of said panel being processed;

(g) said side abutment member and said side pusher being arranged along the longitudinal sides of said elevating table.

2. A shortening device according to claim, 1, further comprising means for orderly removal of the strips cut from the longitudinal side of said panel.

* * * * *